US005469656A

United States Patent [19]

Gier et al.

[11] Patent Number: 5,469,656

[45] Date of Patent: Nov. 28, 1995

[54] SAFETY DEVICE FOR AN ELECTRIC GLASS-WINDER OF A VEHICLE OF THE TYPE HAVING A CABLE SLIDABLE ALONG A GUIDE RAIL

[75] Inventors: Achim R. Gier, Garches; Pascal Bonduel, Sully S/Loire; Robert J. Heckel, Cormeilles; Enrico Fin, Paris, all of France

[73] Assignee: Rockwell Body and Chassis Systems, France

[21] Appl. No.: 411,409

[22] Filed: Mar. 28, 1995

Related U.S. Application Data

[63] Continuation of Ser. No. 80,667, Jun. 18, 1993, abandoned.

[30] Foreign Application Priority Data

Jul. 10, 1992 [FR] France ..... 92 08621

[51] Int. Cl.[6] ..... E05F 15/02

[52] U.S. Cl. ..... 49/28; 49/352

[58] Field of Search ..... 49/26, 28, 31, 49/348, 349, 352

[56] References Cited

U.S. PATENT DOCUMENTS

| | | | |
|---|---|---|---|
| 1,978,126 | 10/1934 | Blodgett . | |
| 2,731,261 | 1/1956 | Drum | 49/26 X |
| 3,012,520 | 12/1961 | Curtis . | |
| 3,022,064 | 2/1962 | Russell . | |
| 3,160,408 | 12/1964 | Woods . | |
| 3,222,487 | 12/1965 | Juptner . | |
| 3,224,493 | 12/1965 | Houk . | |
| 3,250,882 | 5/1966 | Campbell . | |
| 3,281,991 | 11/1966 | Colell . | |
| 3,742,646 | 7/1973 | Piech | 49/349 X |
| 3,946,185 | 3/1976 | Gruner . | |
| 4,035,596 | 7/1977 | Marquardt . | |
| 4,081,632 | 3/1978 | Schaffeler . | |
| 4,090,329 | 5/1978 | Rampel . | |
| 4,277,663 | 7/1981 | Soes . | |
| 4,706,412 | 11/1987 | Kobrehl . | |
| 4,789,764 | 12/1988 | Doros . | |
| 4,803,807 | 2/1989 | Stockermann . | |
| 4,970,827 | 11/1990 | Djordjevic . | |
| 5,074,077 | 12/1991 | Toyoshima . | |
| 5,382,767 | 1/1995 | Takano . | |

FOREIGN PATENT DOCUMENTS

| | | |
|---|---|---|
| 008247A1 | 2/1980 | European Pat. Off. . |
| 0016550 | 10/1980 | European Pat. Off. . |
| 0107531 | 5/1984 | European Pat. Off. . |
| 2100148 | 3/1972 | France . |
| 1244609 | 7/1967 | Germany . |
| 2437615 | 1/1976 | Germany . |
| 2434272 | 2/1976 | Germany . |
| 2644213 | 4/1978 | Germany . |
| 2836032 | 2/1980 | Germany . |
| 2841675 | 2/1981 | Germany . |
| 1712976 | 5/1989 | U.S.S.R. . |
| 822658 | 10/1959 | United Kingdom . |
| 1184645 | 3/1970 | United Kingdom . |
| 2099897 | 12/1982 | United Kingdom . |
| 2188673 | 10/1987 | United Kingdom . |
| WO9010943 | 9/1990 | WIPO . |

*Primary Examiner*—Peter M. Cuomo
*Assistant Examiner*—Jerry Redman

[57] ABSTRACT

A safety device for electric glass-winders of the cable type employs a guide rail movably mounted on the door panel of a vehicle so as to be capable of being driven downwardly in vertical translation by the cable upon encountering a force opposing travel of the glass which exceeds a predetermined value. The rail is maintained in its normal position by, for example, a magnet which attracts a tab of ferromagnetic material fixed to the rail. A switch forming part of the electrical supply circuit for the winder motor cooperates with the rail and reverses the direction of rotation of the motor when the rail is displaced from its normal position to a lower position. The electromechanical safety device is inexpensive and simple to manufacture.

6 Claims, 2 Drawing Sheets

SAFETY DEVICE FOR AN ELECTRIC GLASS-WINDER OF A VEHICLE OF THE TYPE HAVING A CABLE SLIDABLE ALONG A GUIDE RAIL

This is a continuation of U.S. patent application Ser. No. 08/080,667, filed Jun. 18, 1993, now abandoned.

BACKGROUND OF THE INVENTION

1. Field of the Invention

The present invention relates to a safely device for an electric glass-winder of a vehicle of the type employing a cable driving the glass by means of a motor and mounted to slide along a guide rail.

2. Description of the Related Art

There are at present three types of glass-winders in automobile vehicles, namely those employing a rack-type cable, those employing a twisted or Borden cable, and those employing an arm and a toothed sector. The invention concerns the first two types of glass-winders.

When an obstacle lies in the path of the glass when closing the window, the system must become aware of the presence of an abnormal phenomenon and, if the force on the glass exceeds a limit value, the glass must not continue its travel but stop and at least release the applied force. This release of the force may be achieved either by releasing the glass which descends under the effect of a small force or the effect of its own weight if the friction in the lateral seal so permits, or by reversing the direction of motion of the glass which is then forced to descend.

To solve this problem, various electric and electromechanical safety devices have been proposed, but they present, among other drawbacks, the drawback of being relatively costly owing to their complexity. This high manufacturing cost is obviously an obstacle to their widespread use.

SUMMARY OF THE INVENTION

An object of the invention is to provide an electromechanical safety device for cable-type glass-winders which is simple to manufacture and consequently cheap.

According to the invention, the rail is movably mounted relative to a door panel in such a manner as to be drivable in vertical and downward translation by the cable in the event of a detection of a force on the glass which exceeds a predetermined value and opposes the travel of the glass, and this device comprises means for maintaining the rail in a given position so long as the force exerted on the glass remains lower than said predetermined value, and electromechanical means for detecting the force exerted on the glass and displacing the rail in translation when said force exceeds said predetermined value, said electromechanical means then permitting the automatic reversal of the direction of rotation of the motor.

In one embodiment of the invention, said maintaining means comprise a magnet fixed to the door panel and a tab of ferromagnetic material fixed relative to the rail and positioned in such manner as to be maintained magnetically stuck to the magnet so long as the force exerted on the glass remains lower than said predetermined value, and said electromechanical means comprise a switch cooperative with the rail in such manner as to be maintained in a first state so long as the force exerted on the glass is lower than said predetermined value and to pass to a second state when said force is higher than said predetermined value and the rail is then displaced.

Thus, according to the invention, the detection of the force exerted on the glass is effected by a movable rail, the force on the glass being communicated substantially fully to the carriage which carries the glass and is fixed to the cable. This carriage indeed transmits the force to the rail, either through pulleys and elements fixing the cable when the latter is of twisted type, or through the sleeve surrounding the cable when the latter is of the rack type. Thus, while in a conventional glass-winder the guide rail is directly fixed to the inner panel of the door, it is mounted to be slidable in vertical translation relative to the door panel according to the invention and therefore provides an image of the force on the glass.

The invention will now be described with reference to the accompanying drawings which illustrate four embodiments thereof by way of non-limitative examples.

In the drawings:

DESCRIPTION OF THE PREFERRED EMBODIMENTS

Figure 2:
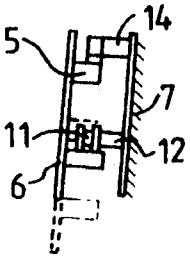
FIG. 2 is a partial side elevational view of the lower part of the device of FIG. 1 in a plane perpendicular to plane of the latter.
Figure 1:
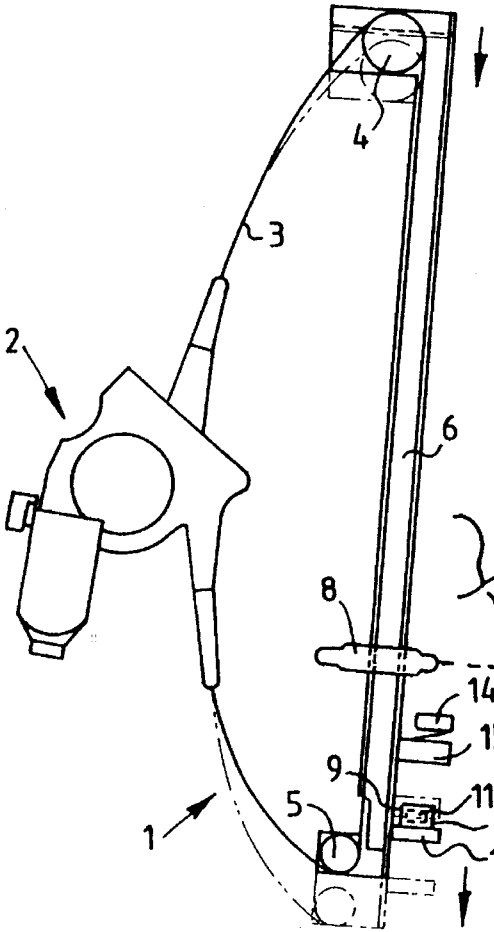
FIG. 1 is a simplified elevational view of a first embodiment of the safety device according to the invention applied to an electric glass-winder employing a Bowden cable.

The glass-winder 1 shown in FIG. 1 comprises a motor-speed reducer unit 2 driving a twisted or Bowden cable 3 which extends around two return pulleys 4, 5. The portion of the cable 3 between these two pulleys extends along a guide rail 6 mounted to be movable in vertical translation relative to a door panel 7 which is partly shown in FIG. 2. The cable 3 carries a carriage 8 on which a window glass 10 is mounted. Fixed to the door panel 7 between two armature plates 9 is a magnet 11, these elements being carried for example by a tab 12 projecting from the panel 7. Complementarily the rail 6 is provided with a tab 13 of ferromagnetic material which extends transversely to the rail 6 under the magnet 71 and is so positioned on the rail as to be maintained magnetically stuck against the magnet 9 so long as the force exerted on the glass remains lower than a predetermined value, in the present case the force of attraction of the magnet 11 on the tab 13. Further, the safety device comprises electromechanical means including an electric switch 14 which is carried by the panel 7 and whose movable contact is cooperative with a transverse tab 15 of the rail 6. Thus the switch 14 may be maintained in a first state so long as the force exerted on the glass remains lower than the force of attraction of the magnet 11 on the tab 13. The switch can pass to the second state when this force is higher than said force of attraction and the rail 6 is then displaced vertically downwardly in translation thereby causing the tab 13 to move away from the magnet 11 and the switch 14.

The switch 14 is part of a suitable electric circuit which has not been shown since it is known per se and consequently needs no description. This circuit reverses the direction of rotation of the motor of the motor-speed reducer unit 2 so as to cause the glass to descend and release the obstacle when the switch 14 passes to its second state.

The initial position is the upper position shown in full lines in FIG. 1 in which the switch 14 is actuated and the tab 13 of the rail 6 is attracted by the magnet 11. If the force on the glass exceeds the limit determined by the force of attraction of the magnet 11 on the tab 13 as a result of the interposition of an obstacle in the path of the glass, the rail 6 will descend and the switch 14 will no longer be actuated.

Figure 3:
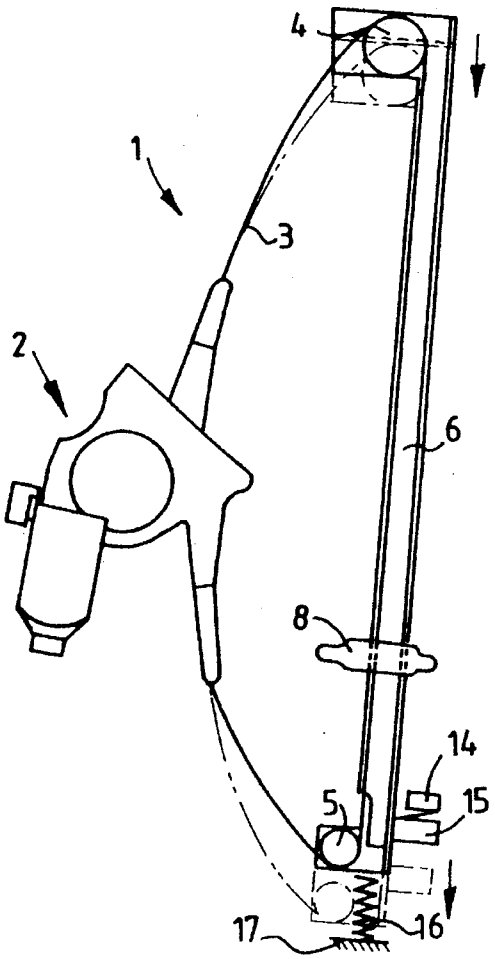
FIGS. 3 and 4 are elevational views similar to FIG. 1 illustrating two other embodiments of the safety device according to the invention applied to glass-winders employing a twisted cable.

The embodiment of the safety device illustrated in FIG. 3 differs from the foregoing solely in that the detection of the force is achieved by means of a compression spring 16 placed under the lower end of the rail 6. The spring 16 maintains the latter in the upper position so long as the force exerted on the glass, and transmitted to the rail 6 by the carriage 8 and the cable 3, remains lower than a predetermined value. The latter here corresponds to the prestress in the spring 16 whose lower end bears against a fixed point 17 (door panel 7 for example). When the force exerted on the glass owing to the interposition of an obstacle in its upward path exceeds the prestress in the spring 16, the rail 6 is driven downwardly in translation in opposition to the return force of the spring 16. The tab 15 moves away from the switch 14 which is no longer actuated and the electric circuit of which the switch 14 is part automatically reverses the direction of rotation of the motor of the motor-speed reducer unit 2.

Figure 4:
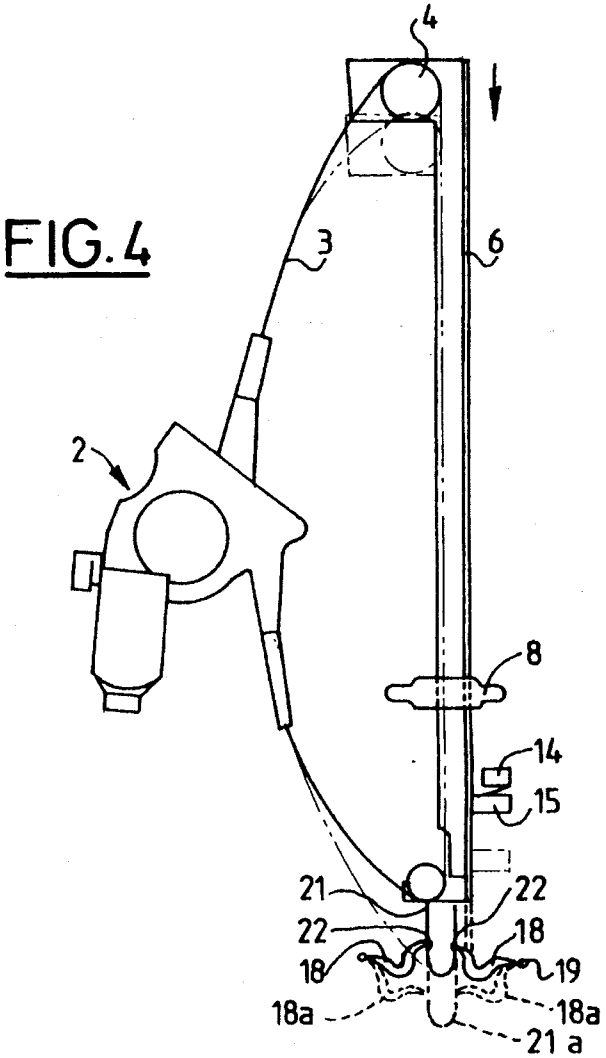

The embodiment of the safety device illustrated in FIG. 4, which is also applied to a glass-winder of the type employing a twisted cable 3, comprises two elastically yieldable elements 18 which may be limited to a single element in an alternative arrangement. Each of the elastically yieldable elements 18 is constituted by a prestressed spring having one end pivotally mounted on a pin 19 carried by the door panel (not shown) and the other end coupled to the movable rail 6. This coupling may be achieved for example, as shown, by means of a finger member 21 which extends downwardly beyond the lower end of the rail 6 and has a surface defining notches 22 (or a groove) in which the end of each spring 18 is removably engaged. The two springs 18 can therefore assume two stable positions, namely a first or upper position corresponding to the normal position of the rail 6 shown in full lines, and a second or lower position shown in dot-dash lines (18*a*, 21*a*), assumed by the rail 6 after a force exceeding the prestress in the springs 18 has downwardly displaced the rail 6.

In the normal upper position of the rail 6, the springs 18 exert on the finger member 21 and the rail 6, and on the pulleys 4, 5 and the cable 3, vertical forces which maintain the assembly in this position so long as the glass is not subjected to a force which opposes its travel and is greater than the prestress in the springs 18. The system shown in FIG. 4 consequently has a memory termed "intrinsic mechanical memory". If the force exceeds the value of this prestress, the rail 6 transmits it through the finger member 21 to the springs 18 and descends to its second or lower stable position. It is then maintained in this position by the vertically directed forces of the springs 18 which are maintained downwardly oriented. As soon as the rail 6 changes its position, the switch 14 also changes position and the electric circuit of which it is part reverses the motion of the glass by reversing the direction of rotation of the motor. To resume the initial position, the force of the springs 18 must be overcome, for example by prolonging the pressure on the control button of the electric circuit causing the descent while the glass is in its lower position.

Figure 5:
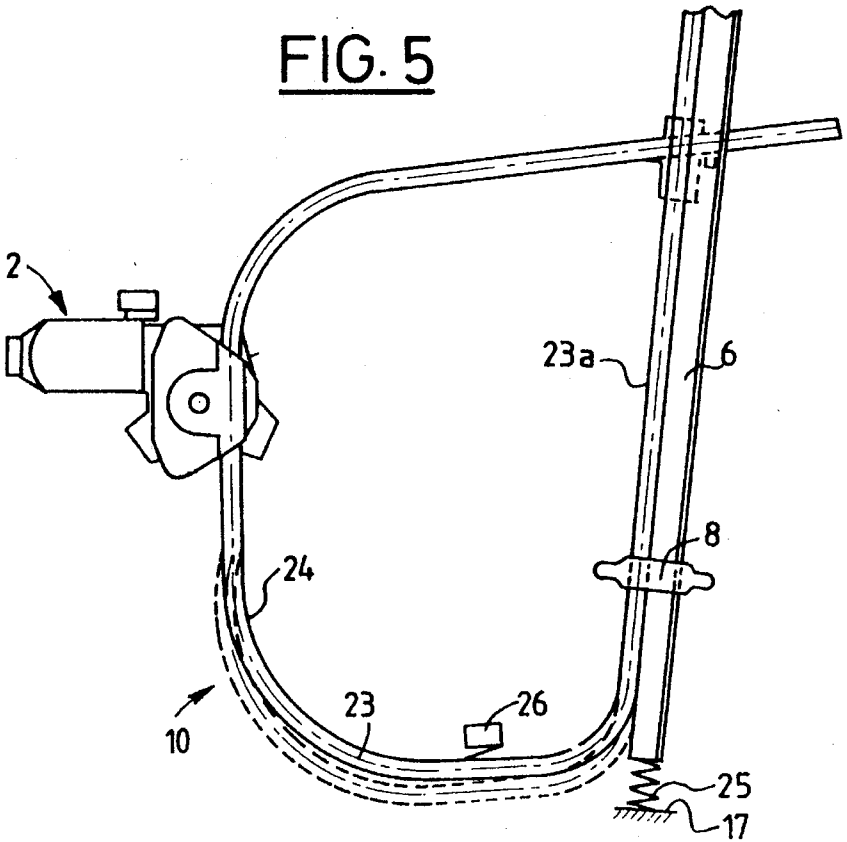
FIG. 5 is a simplified elevational view of a glass-winder employing a rack-type cable provided with a fourth embodiment of the safety device according to the invention.

The fourth embodiment of the invention illustrated in FIG. 5 is applied to a glass-winder 10 which employs a rack-type cable 23 sliding in a sleeve 24 whose substantially vertical portion 23*a* extends along the guide rail 6. The sleeve 23 and the rail 6 are together movable in vertical translation relative to the door panel (not shown). The rail 6 is mounted to bear by its lower end against a compression spring 25 whose end bears against a fixed point 17. The safety device also comprises a switch 26 cooperative with the sleeve 23 as shown, or in an alternative arrangement with the rail 6, so as to be capable of assuming two successive states: the first state corresponds to the upper position of the sleeve 3 and rail 6, shown in full line in FIG. 4, and the second to the lower position, shown in dot-dash lines, which is assumed as soon as the glass is subjected to a force which opposes the upward travel of the glass and exceeds a predetermined limit value. In the present instance, the latter is the return force exerted by the spring 25 which normally maintains the rail 6 and sleeve 23 in the upper position.

The switch 26 is, as the other switches 14, part of an electric control circuit known per se which is capable of reversing the direction of rotation of the motor driving the cable 23 after the descent of the sleeve 23 and rail 6 and the change in the state of the switch 26.

It should be noted that, whereas the device shown in FIG. 4 has a mechanical memory, the devices shown in FIGS. 1, 2, 3 and 5 require electric circuits having an electric memory, since these safety devices return substantially immediately to their initial State after the detection of the force exceeding the limit value and the reversal of the motion.

It must be understood that the scope of the invention is not intended to be limited to the embodiments described hereinbefore and may include various variants. For example, the switch 26 shown in FIG. 5 may be displaced so as to cooperate with the rail 6 as in FIGS. 1 to 4.

What is claimed is:

1. In a safety device for an electric glass-winder mounted on a door panel having an electric motor fixedly attached to said door panel, a cable drivenly connected to said electric motor and drivingly connected to a window, said cable mounted so as to be slidable along a guide rail mounted on said door panel, a carriage carrying said window fixed to said cable, said safety device adapted to reverse the direction of rotation of said electric motor upon said window encountering a force of a first value opposing the travel of said window, the improvement comprising:

a) said guide rail movedly mounted on said door panel so as to be capable of being downwardly displaced in substantially vertical translation by said cable due to said force on said window exceeding said first value;

b) rail maintaining means for maintaining said guide rail in a given position so long as said force remains lower than said first value;

c) electromechanical means for detecting said force and displacing said guide rail in substantially vertical translation when said force exceeds said first value, d) said electromechanical means causing reversal of the direction of rotation of said electric motor when said guide rail is displaced.

2. Device according to claim 1, wherein said rail maintaining means comprise a magnet fixed relative to said door panel and a tab composed of a ferromagnetic material which is fixed to said rail and positioned in such manner as to be maintained magnetically stuck to said magnet so long as the force exerted on said glass remains lower than said first value, and said electromechanical means comprise a switch cooperative with said rail in such manner as to be maintained in a first state so long as the force exerted on said glass is lower than said first value and to pass to a second state when said force exceeds said first value and said rail is then displaced.

3. Device according to claim 1, wherein said rail maintaining means comprise a spring which is placed under the lower end of said rail, maintaining said rail in an upper position and is compressible when said rail is displaced downwardly in translation, and said electromechanical means comprises a switch which is part of an electric control circuit and is cooperative with said rail in such manner as to be maintained in a first state so long as the force exerted on said glass is lower than said first value and to pass to a second state when said force exerted on said glass exceeds said first value and said rail is then displaced.

4. Device according to claim 1, wherein said rail maintaining means comprise at least one prestressed elastically yieldable element having an end pivotally mounted on a support which is fixed relative to said door panel and another end coupled to said rail in such manner as to be capable of assuming two stable positions, namely a first upper position corresponding to a normal position of said rail and a lower position assumed by said rail after a force exceeding said first value has downwardly displaced said rail.

5. Device according to claim 4, wherein said electromechanical means comprise a switch which is part of an electric control circuit, said switch being mounted on said door panel and cooperative with said rail in such manner as to be capable of assuming two successive states respectively corresponding to the upper position and the lower position of said rail.

6. Device according to claim 1, wherein said glass-winder employs a rack-type cable and a sleeve containing said rack-type cable, said rail and said sleeve being mounted to be movable in substantially vertical translation, said rail being mounted to bear by a lower end thereof on a spring, and said electromechanical means comprises a switch which is part of an electric control circuit and is cooperative with an element, selected from the group consisting of said sleeve and said rail, in such manner as to be capable of assuming two successive states respectively corresponding to an upper position and a lower position of said rail and said sleeve, said lower position being the position occupied after a force exceeding said first value has been exerted on said glass.

* * * * *